US008826490B1

(12) United States Patent
Giarmo

(10) Patent No.: US 8,826,490 B1
(45) Date of Patent: Sep. 9, 2014

(54) ACCESSORY HOLDER ATTACHMENT

(71) Applicant: John A. Giarmo, Monroe, MI (US)

(72) Inventor: John A. Giarmo, Monroe, MI (US)

( * ) Notice: Subject to any disclaimer, the term of this patent is extended or adjusted under 35 U.S.C. 154(b) by 0 days.

(21) Appl. No.: 13/935,356

(22) Filed: Jul. 3, 2013

(51) Int. Cl.
*A47L 5/00* (2006.01)
*A47L 5/36* (2006.01)
*A47L 9/00* (2006.01)

(52) U.S. Cl.
CPC ..... *A47L 9/0009* (2013.01); *A47L 9/0027* (2013.01); *A47L 5/36* (2013.01); *A47L 5/00* (2013.01)
USPC ..... 15/323; 15/327.1

(58) Field of Classification Search
CPC ..... A47L 5/00; A47L 5/36; A47L 9/0027
USPC ..... 15/323, 327.1
IPC ..... A47L 5/00, 5/36, 9/00
See application file for complete search history.

(56) References Cited

U.S. PATENT DOCUMENTS 7,478,456 B2 * 1/2009 Barker et al. ..... 15/323

* cited by examiner

*Primary Examiner* — David Redding

(57) ABSTRACT

An accessory holder attachment for a cleaning wand of a carpet cleaning system includes a base frame, a plurality of holding canisters carried by the base frame, an attachment space formed by and between the plurality of holding canisters and a wand attachment device carried by the at least one holding canister within the attachment space.

19 Claims, 3 Drawing Sheets

ACCESSORY HOLDER ATTACHMENT

FIELD

Illustrative embodiments of the disclosure generally relate to carpet cleaning systems and accessories. More particularly, illustrative embodiments of the disclosure relate to an accessory holder attachment which can be attached to a cleaning wand of a carpet cleaning system to hold bottles of liquid carpet cleaning agents and other accessories in a location which is easily accessible to an operator.

BACKGROUND

Carpet cleaning systems are frequently used to clean soiled carpet in a residential or commercial setting. Conventional carpet cleaning systems may utilize steam and cleaning compounds to remove stains from the carpet. Liquid carpet cleaning agents may be applied with steam to the stains on the carpet to emulsify and facilitate removal of the staining substances from the carpet.

In a carpet-cleaning operation, liquid carpet cleaning agents may be dispensed onto the carpet from hand-held bottles. However, these bottles may be inadvertently left in a van or other transporting vehicle, in which case the operator of the carpet cleaning system may be required to temporarily leave the carpet cleaning operation to retrieve the bottles.

Accordingly, an accessory holder attachment which can be attached to the cleaning wand of a carpet cleaning system to hold bottles of liquid carpet cleaning agents and other accessories in a location which is easily accessible to an operator of the system may be desirable.

SUMMARY

Illustrative embodiments of the disclosure are generally directed to an accessory holder attachment for a cleaning wand of a carpet cleaning system. The accessory holder attachment may include a base frame, a plurality of holding canisters carried by the base frame, an attachment space formed by and between the plurality of holding canisters and a wand attachment device carried by the at least one holding canister within the attachment space.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "lower", "front" and "rear" are intended to be used in an illustrative and not a limiting sense. In some applications, for example, those elements which are identified as "upper" may be located in other spatial relationships relative to those elements which are identified as "lower" in the following detailed description.

Figure 1:
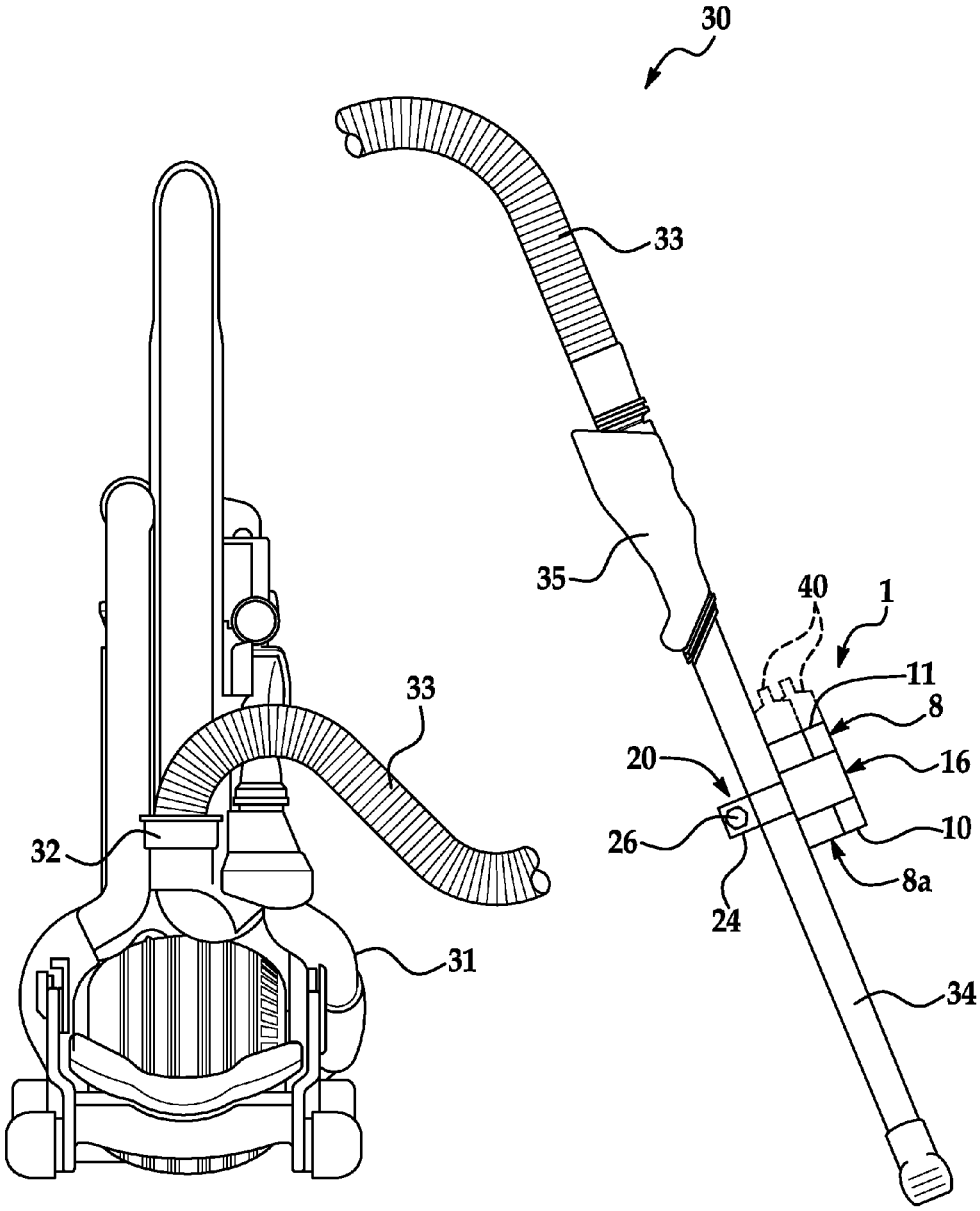
FIG. 1 is a front view, partially in section, of an exemplary carpet cleaning system, with an illustrative embodiment of the accessory holder attachment mounted on a cleaning wand of the system and multiple bottles (illustrated in phantom) of carpet cleaning agent supported by the accessory holder attachment.

Referring initially to FIG. 1 of the drawings, an illustrative embodiment of the accessory holder attachment is generally indicated by reference numeral 1. The accessory holder attachment 1 is adapted for attachment to a cleaning wand 34 of a carpet cleaning system 30. The carpet cleaning system 30 may be a standard or conventional steam cleaning system which is known by those skilled in the art and may include a portable carpet cleaning unit 31 having a hose attachment interface 32 and a flexible hose 33 which connect the cleaning wand 34 to the carpet cleaning unit 31. The cleaning wand 34 may be fitted with a cleaning wand handle 35. As will be hereinafter further described, the accessory holder attachment 1 is adapted to hold one or multiple bottles 40 which contain carpet cleaning agents used in operation of the carpet cleaning system 30. The accessory holder attachment 1 may additionally be adapted to hold one or more additional carpet cleaning accessories (not illustrated). The carpet cleaning agent bottles 40 and other carpet cleaning accessories are readily accessible to an operator (not illustrated) of the carpet cleaning system 30 during operation of the carpet cleaning system 30.

Figure 5:
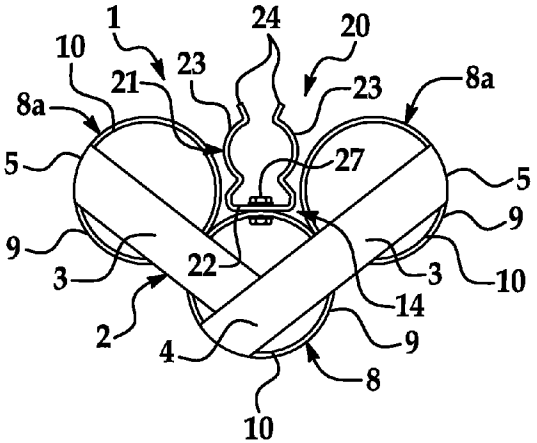
FIG. 5 is a bottom view of an illustrative accessory holder attachment.
Figure 4:
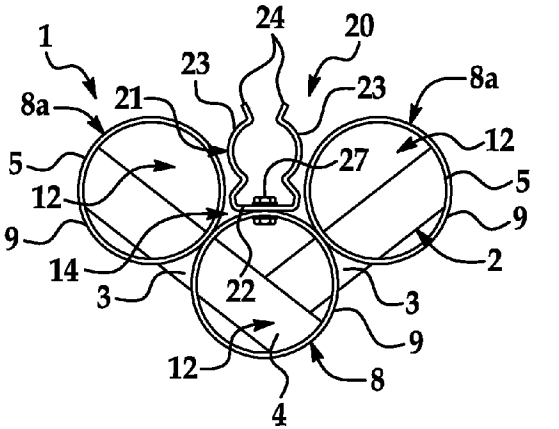
FIG. 4 is a top view of an illustrative accessory holder attachment.
Figure 7:
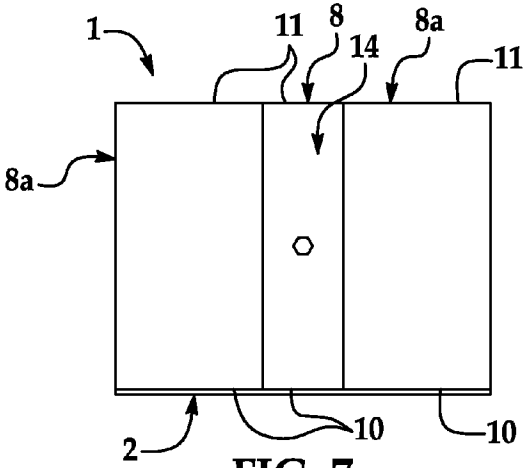
FIG. 7 is a rear view of an illustrative accessory holder attachment.

As particularly illustrated in FIGS. 4 and 5, the accessory holder attachment 1 includes a base frame 2. The base frame 2 may include a pair of generally elongated base frame members 3. The base frame members 3 may be disposed in a generally V-shaped configuration, as illustrated, with a base frame vertex 4 at the junction between the base frame members 3 and base frame ends 5 opposite the base frame vertex 4. The base frame members 3 of the base frame 2 may be metal, plastic or other substantially rigid material.

Figure 2:
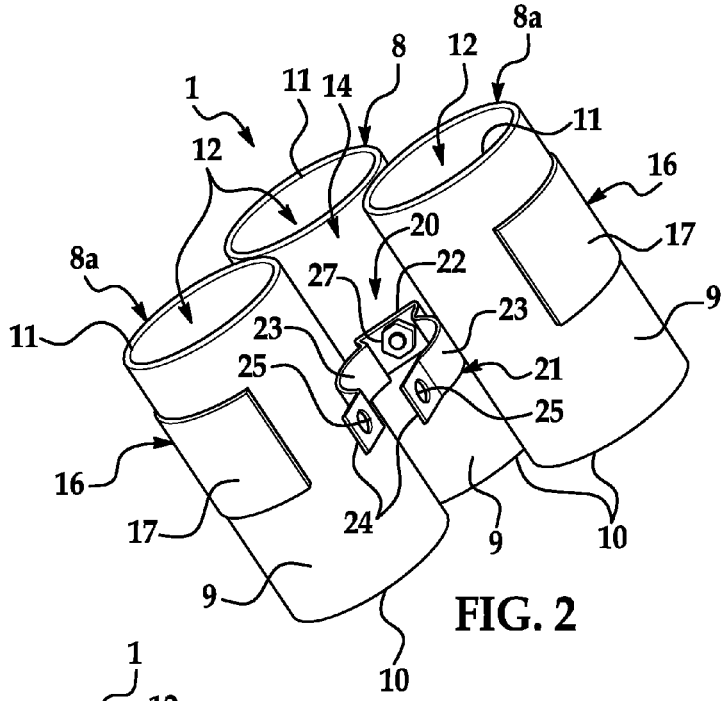
FIG. 2 is a rear perspective view of an illustrative accessory holder attachment.

Multiple holding canisters 8, 8*a* are supported by the base frame members 3 of the base frame 2. In some embodiments, a middle holding canister 8 and a pair of side holding canisters 8*a* may be supported by the base frame 2, as illustrated. Each of the middle holding canister 8 and the side holding canisters 8*a* may have a tubular construction with a canister wall 9 which may be generally elongated and cylindrical. As illustrated in FIG. 2, the canister wall 9 may have a base end 10 which is supported by the base frame 2 and an insertion end 11 which is opposite the base end 10. A canister interior 12 may extend between the base end 10 and the insertion end 11. The base frame 2 may close the canister interior 12 at the base end 10 of each of the holding canisters 8, 8*a*.

As further illustrated in FIGS. 4 and 5, the middle holding canister 8 may be supported at the base frame vertex 4 of the base frame members 3. The side holding canisters 8*a* may be supported at the respective base frame members 3. Each base frame ends 5 of the base frame 2 may terminate at the canister wall 9 of each corresponding side holding canister 8*a*. Accordingly, the middle holding canister 8 and the side holding canisters 8*a* may be arranged in a generally V-shaped configuration which substantially matches the V-shaped configuration of the base frame 2.

Figure 3:
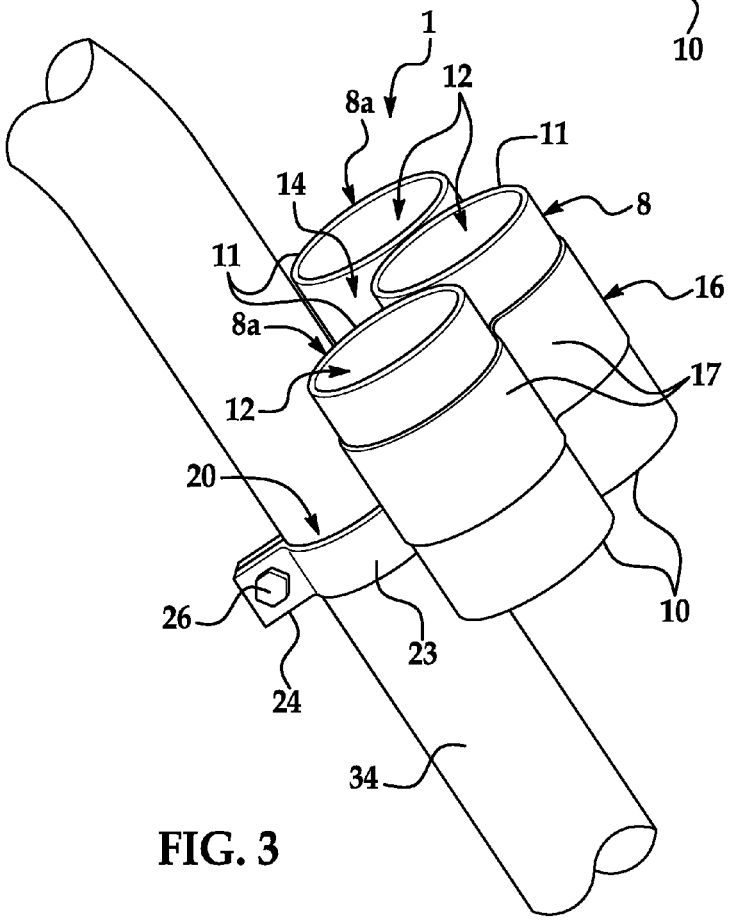
FIG. 3 is a side perspective view of an illustrative accessory holder attachment, more particularly illustrating an exemplary clamp technique for attaching the accessory holder attachment to a cleaning wand.

An attachment space 14 may be formed by and between the middle holding canister 8 and the side holding canisters 8*a*. A wand attachment device 20 is provided on at least one of the middle holding canister 8 and the side holding canisters 8*a*. The wand attachment device 20 may include any type of device or mechanism which is suitable for the purpose of attaching the accessory holder attachment 1 to the cleaning wand 34 of the carpet cleaning system 30. As illustrated in FIG. 2, in some embodiments, the wand attachment device 20 may include at least one wand attachment clamp 21. The wand attachment clamp 21 may include a clamp base 22 which is attached to the canister wall 9 of the middle holding canister 8 such as by using a clamp attachment bolt 27. A pair of spaced-apart clamp arms 23 may extend from the clamp base 22. The clamp arms 23 may terminate in a pair of clamp flanges 24 having clamp fastener openings 25. As illustrated in FIG. 3, the clamp arms 23 are adapted to be extended around the respective sides of the cleaning wand 34. A clamp fastener 26 may be extended through the flange openings 25 (FIG. 2) to secure the clamp arms 23 in engagement with the cleaning wand 34.

Figure 6:
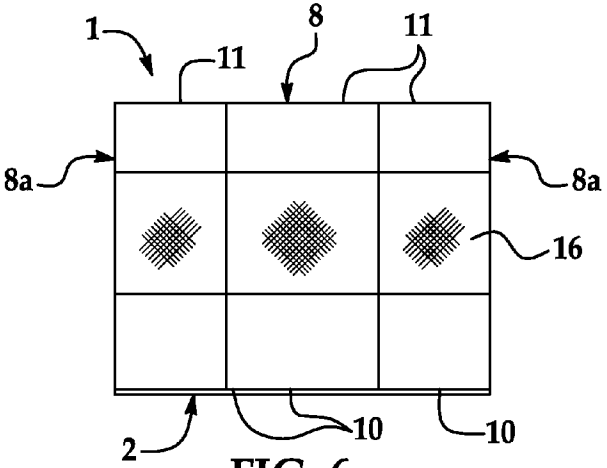
FIG. 6 is a front view of an illustrative accessory holder attachment.

As illustrated in FIGS. 2, 3 and 6, in some embodiments, at least one accessory attachment strip 16 may be provided on and face outwardly from the exterior surface of the canister wall 9 of at least one of the middle holding canister 8 and the side holding canisters 8*a*. The accessory attachment strip 16 may have an attachment surface 17. The attachment surface 17 of the accessory attachment strip 16 may include hook elements or loop elements (not illustrated) of a hook and loop fastener. Accordingly, additional accessories (not illustrated) such as brushes, for example and without limitation, may be detachably attached to the accessory attachment strip 16 by attaching a hook or loop attachment strip element (not illustrated) on the accessory with a companion hook or loop attachment strip element on the attachment surface 17 of the accessory attachment strip 16.

In exemplary application of the accessory holder attachment 1, the wand attachment device 20 is attached to the cleaning wand 34 of the carpet cleaning system 30 typically beneath the cleaning wand handle 35, as illustrated in FIGS. 1 and 3. When the cleaning wand 34 is disposed in the operational position illustrated in FIG. 1, the accessory holder attachment 1 is oriented in a generally vertical position with the base ends 10 of the respective holding canisters 8, 8*a* facing downwardly and the insertion ends 11 of the respective holding canisters 8, 8*a* facing upwardly. At least one bottle 40 of liquid carpet cleaning agent is placed in the canister interior 12 of at least one of the holding canisters 8, 8*a*. The operator (not illustrated) of the carpet cleaning system 30 grips the cleaning wand handle 35 and manipulates the cleaning wand 34 as the carpet cleaning system 30 is operated typically to remove spots or stains from carpet (not illustrated). The bottles 40 are supported in a generally upright position beneath the cleaning wand handle 35 such that the operator can easily access and remove the bottles 40 from one or more of the holding canisters 8, 8*a* for application of the liquid cleaning agent to the carpet and then replace the bottles 40 in the holding canisters 8, 8*a*. In some applications, additional attachments such as brush attachments (not illustrated) for the cleaning wand 34 may be detachably attached to the accessory attachment strip 16 for placement on the cleaning wand 34.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. An accessory holder attachment for a cleaning wand of a carpet cleaning system, comprising:

a base frame;

a plurality of holding canisters carried by the base frame; the plurality of holding canisters comprises a middle holding canister and a pair of side holding canisters on opposite sides of the middle holding canister;

an attachment space formed by and between the plurality of holding canisters; and a wand attachment device carried by the at least one holding canister within the attachment space.

2. The accessory holder attachment of claim 1 wherein each of the plurality of holding canisters comprises a canister wall having a base end carried by the base frame, an insertion end opposite the base end and a canister interior extending between the base end and the insertion end.

3. The accessory holder of claim 2 wherein the base frame closes the canister interior.

4. The accessory holder of claim 1 wherein the base frame has a generally V-shaped configuration.

5. The accessory holder of claim 4 wherein the base frame comprises a pair of generally elongated base frame members.

6. The accessory holder of claim 1 wherein the wand attachment device comprises a wand attachment clamp.

7. The accessory holder attachment of claim 1 wherein the wand attachment device comprises a wand attachment clamp carried by the middle holding canister.

8. An accessory holder attachment for a cleaning wand of a carpet cleaning system, comprising:

a base frame;

a plurality of holding canisters carried by the base frame;

an attachment space formed by and between the plurality of holding canisters;

a wand attachment device carried by the at least one holding canister within the attachment space; and an accessory attachment strip having an attachment surface carried by and facing outwardly from at least one of the plurality of holding canisters.

9. The accessory holder attachment of claim 8 wherein the plurality of holding canisters comprises a middle holding canister and a pair of side holding canisters on opposite sides of the middle holding canister.

10. The accessory holder attachment of claim 8 wherein each of the plurality of holding canisters comprises a canister wall having a base end carried by the base frame, an insertion end opposite the base end and a canister interior extending between the base end and the insertion end.

11. The accessory holder of claim 10 wherein the base frame closes the canister interior.

12. The accessory holder of claim 8 wherein the base frame has a generally V-shaped configuration.

13. The accessory holder of claim 12 wherein the base frame comprises a pair of generally elongated base frame members.

14. The accessory holder of claim 8 wherein the wand attachment device comprises a wand attachment clamp.

15. The accessory holder attachment of claim 8 wherein the plurality of holding canisters comprises a middle holding canister and a pair of side holding canisters on opposite sides of the middle holding canister, and the wand attachment device comprises a wand attachment clamp carried by the middle holding canister.

16. An accessory holder attachment for a cleaning wand of a carpet cleaning system, comprising:

a generally V-shaped base frame having a base frame vertex and a pair of base frame ends;

a middle holding canister carried by the base frame at the base frame vertex;

a pair of side holding canisters carried by the base frame at the pair of base frame ends, respectively;

an attachment space formed by and between the center holding canister and the pair of side holding canisters;

a wand attachment device carried by the at least one holding canister within the attachment space; and an accessory attachment strip having an attachment surface carried by and facing outwardly from at least one of the center holding canister and the pair of side holding canisters.

17. The accessory holder attachment of claim 16 wherein each of the plurality of holding canisters comprises a canister wall having a base end carried by the base frame, an insertion end opposite the base end and a canister interior extending between the base end and the insertion end.

18. The accessory holder of claim 17 wherein the base frame closes the canister interior.

19. The accessory holder of claim 16 wherein the wand attachment device comprises a wand attachment clamp.

* * * * *